United States Patent [19]

Banks

[11] 4,170,356

[45] Oct. 9, 1979

[54] GOLF SWING TRAINING DEVICE

[76] Inventor: James F. Banks, P.O. Box 67, East Haddam, Conn. 06423

[21] Appl. No.: 907,156

[22] Filed: May 17, 1978

[51] Int. Cl.[2] ..... A63B 69/36

[52] U.S. Cl. ..... 273/186 A; 273/186 C; 273/194 R; 248/541

[58] Field of Search ..... 273/163 R, 163 A, 186 A, 273/186 C, 183 D, 193 R, 194 R

[56] References Cited

U.S. PATENT DOCUMENTS

| | | | |
|---|---|---|---|
| 2,462,955 | 3/1949 | Glancey | 273/194 R |
| 3,301,561 | 1/1967 | Kaiser | 273/186 A |

*Primary Examiner*—George J. Marlo

*Attorney, Agent, or Firm*—McCormick, Paulding & Huber

[57] ABSTRACT

A golf swing training device comprises a mounting bracket positioned on the shaft of a golf club, a fastener which has a threaded shank engaged with the bracket and an enlarged head, a rod which extends through an aperture in the head, and a clamping sleeve received on the head between the bracket and the rod. The fastener cooperates with the bracket and the sleeve to releasably secure the bracket to the club shaft with the rod in an extending position. The position of the rod is adjusted so that a free end of the rod touches one shoulder of a golfer when he has executed a proper backswing.

7 Claims, 5 Drawing Figures

GOLF SWING TRAINING DEVICE

BACKGROUND OF THE INVENTION

This invention relates in general to golf training aids and deals more particularly with an improved golf swing training device of a type which is attached to the shaft of a golf club and adapted to make contact with a predetermined portion of a golfer's body when he swings the club in a proper manner. The device is particularly adapted to aid a golfer to develop a proper backswing.

Devices of the aforedescribed type have been heretofore available for monitoring a golfer's swing, generally provide audible or visible signals to indicate predetermined club swing conditions and generally requires either a connection between the golf club and a portion of the golfer's body or sustained contact between an attachment carried by the golf club and a part of the golfer's body during a substantial portion of his swing. Typical training devices of the aforedescribed general type are disclosed in U.S. Pat. Nos. 4,023,812 to Lorang, issued May 17, 1977 and 3,954,271 to Tredway, Sr., issued May 4, 1976. However, it is obvious that any auxiliary training device which requires connection between the golf club and a part of the golfer's body or which must remain in contact with the golfer's body during a portion of his swing may impair or otherwise interfere with the golfer's normal swing pattern and interfere with his concentration. At least one such device has been provided for indicating that a golf club is properly positioned at the end of the backswing by touching contact with the user's body. This device is shown in U.S. Pat. No. 2,462,955 to Glancey. It is the general aim of the present invention to provide an improved adjustable golf swing training device which does not require connection between a portion of the golfer's body and club and which makes contact with the golfer's body only after a proper backswing has been fully executed.

SUMMARY OF THE INVENTION

In accordance with the present invention an improved golf swing training device is provided which comprises an elongated member and mounting means for releasably securing the member to an upper portion of a golf club shaft for angular adjustment relative to the shaft and about a supporting axis, which extends in the transverse direction relative to the club shaft axis and the longitudinal axis of the member axis, and for rectilinear adjustment in the direction of the longitudinal axis of the member and relative to the supporting axis.

DETAILED DESCRIPTION OF PREFERRED EMBODIMENT

Figure 1:
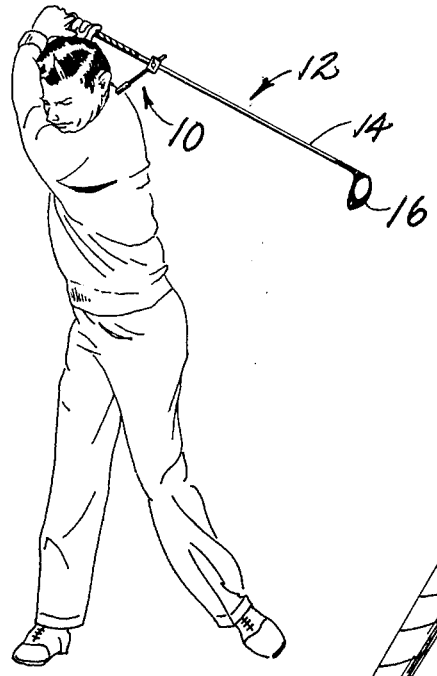
FIG. 1 is a perspective view of a golfer using a training device embodying the present invention.
Figure 5:
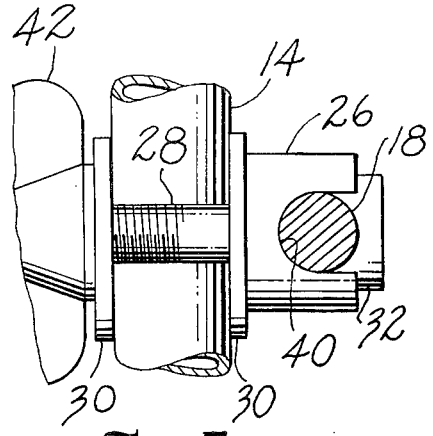
FIG. 5 is a somewhat enlarged fragmentary rear elevational view of the device as shown in FIG. 1.
Figure 2:
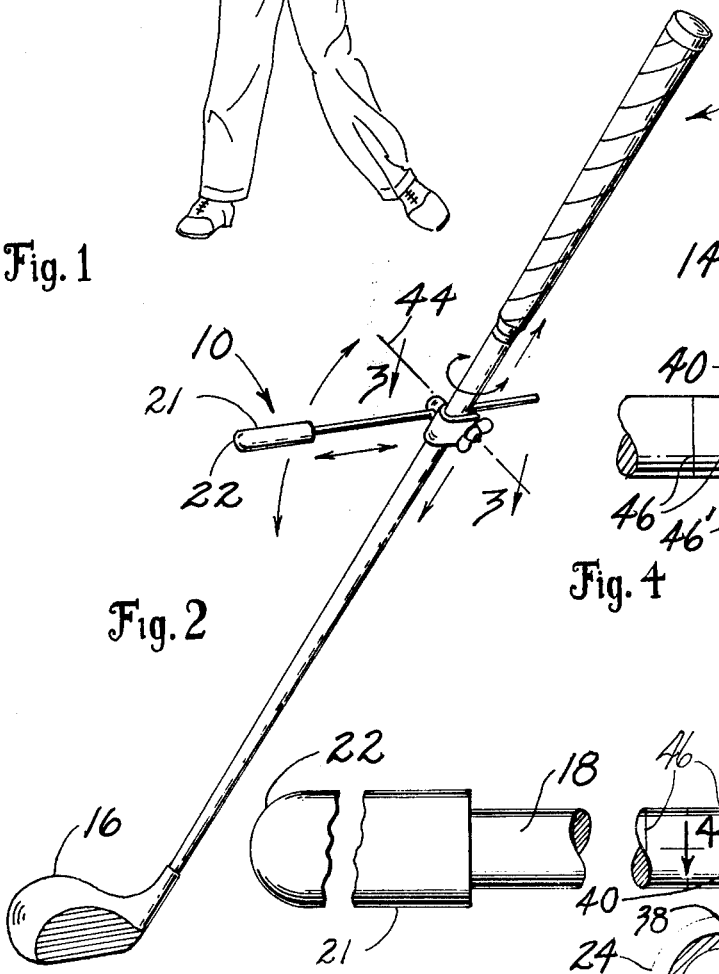
FIG. 2 is a perspective view of a golf club which has a training device embodying the present invention attached thereto.

Turning now to the drawing, and referring particularly to FIGS. 1 and 2, a golf swing training device embodying the present invention, and indicated generally at 10, is shown attached to a golf club, designated generally by the numeral 12, which has an elongated shaft 14 and a head 16 at its lower end. The device 10 generally comprises an elongated member or rod 18 and a mounting assembly, indicated generally at 20, which releasably secures the rod 18 to an upper portion of the club shaft 14 for adjustable positioning relative to the shaft, as will be hereinafter further discussed. The rod 18 has a free end 22 which is adjustably positioned relative to the club shaft and secured in desired position by the mounting means so that it will touch a portion of a golfer's body at a predetermined position when the golfer has executed a proper backswing with the club 12.

Figure 4:
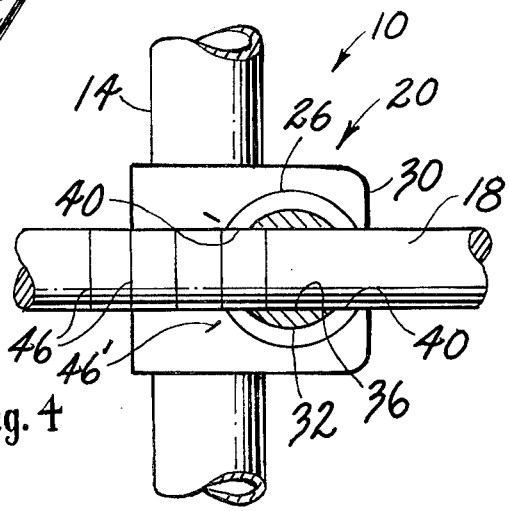
FIG. 4 is a fragmentary sectional view taken along the line 4—4 of FIG. 3.
Figure 3:
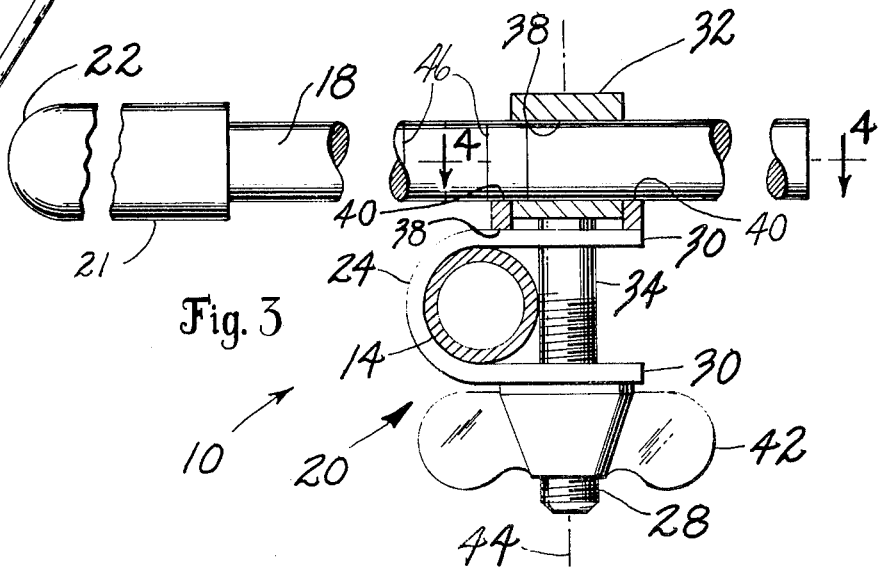
FIG. 3 is a somewhat enlarged fragmentary sectional view taken along the line 3—3 of FIG. 2.

Considering now the structure of the illustrated device 10 in further detail and referring more particularly to FIGS. 3 and 4, the rod 18 comprises a generally cylindrical rigid rod which has a soft resilient tip 21, made from rubber or the like, which may be forced onto an end of the rod to extend therebeyond. The soft tip 21 defines the free end 22 and may, for example, comprise a hollow molded member, substantially as shown in FIG. 3, or sleeve formed from soft tubing.

The mounting assembly 20 comprises a mounting bracket 24, a clamping member 26, and a single fastener 28 which cooperates with the clamping member to releasably secure the mounting bracket to the club shaft and the rod 18 in fixed position relative to the mounting bracket. More specifically, the mounting bracket 24 comprises a generally U-shaped bracket adapted to partially surround an associated upper portion of the club shaft 14, as best shown in FIG. 3, and has a pair of spaced apart legs 30, 30, the terminal end portions of which project beyond the shaft 14 at opposite sides thereof, substantially as shown.

The fastener 28 has a generally cylindrical head 32 at one end and an elongated threaded shank 34 which projects coaxially from the head and extends through holes formed in the bracket legs 30, 30. A cylindrical aperture 36 extends diametrically through the head 32 for receiving the rod 18. The clamping member 26, which is carried by the fastener 28, preferably comprises a cylindrical sleeve slidably received on the head 32. The sleeve 26 has an axially inwardly facing annular abutment surface 38 at its inner end which engages one of the legs 30, 30. Diametrically opposed semi-cylindrical notches 40, 40 formed in the sleeve 26 are coaxially aligned with the aperture 36 and define axially outwardly facing abutment surfaces for engaging the rod 18. The rod 18 extends through the aperture 36 and through the notches 40, 40, substantially as shown in FIG. 3. A wing nut 42 threadably engaged with the shank 34 bears against an associated one of the legs 30, 30 and maintains the adjustable bracket assembly 20 and the rod 18 in assembly with the club shaft 14.

The fastener 28 provides a support axis 44 about which the rod 18 may be angularly adjusted when the wing nut 42 is loosened. It will be noted that the supporting axis 44 extends in a transverse direction relative to both the longitudinal axis of the club shaft 14 and the longitudinal axis of the rod 18. When the wing nut 42 is loosened the rod 18 is slidably movable within the bore 36 and the notches 40, 40 and is thereby supported for rectilinear adjustment in the direction of its longitudinal axis, so that its free end 22 may be moved toward or away from the supporting axis 44. The rod 18 may also be angularly adjusted about the longitudinal axis of the club shaft 14, when the wing nut is loosened, and may be moved to any desired position along the club shaft.

The mounting bracket assembly 20 is secured to the club shaft and rod 18 is secured in fixed position relative to the bracket assembly by tightening the wing nut 42. Tightening the wing nut 42 causes the head 32 to be drawn toward the mounting bracket 24. The fastener 28 exerts axially directed force upon the rod 18 in the direction of the clamping member 26. The rod 18, in turn, exerts force upon the clamping member 26 in the direction of the bracket 24. The abutment surface 38 and the wing nut 42 exert opposing forces on the legs 30, 30 which draws the bracket member 24 into clamping engagement with the club shaft 14. The abutment surfaces 40, 40 on the clamping member 26 further cooperates with the fastener 28 to exert binding force on the rod 18 which secures the rod in fixed position relative to the bracket assembly 20, whereby the device is releasably secured to the golf club 12 in a desired position of adjustment.

As previously noted, the device is positioned on the club shaft 14 so that the free end 22 will touch a portion of the golfer's body in the region of one of his shoulders when the golfer has executed a proper backswing with the golf club 12. If the golfer is right-handed the device will be adjusted to touch his right shoulder, as illustrated in FIG. 1. It will be apparent that the position of the device on a given golf club will be determined by the length of the club shaft and the particular body characteristics of the golfer using the device. Preferably, the device should be initially adjusted under the direction of a professional golfer so that the free end 22 will be properly positioned to touch the golfer's shoulder when the club has attained its proper position at the end of a well executed backswing.

Suitable reference marks such as shown at 46, 46' may be applied to the rod 18 and to the bracket 24 to enable the device to be removed from the golf club 12 and reassembled therewith at a later time and in a previously determined position of adjustment.

Since the device 10 contacts the golfer's body only upon completion of a fully executed backswing, the device will not interfere with the golfer's movements or otherwise distract him when he is concentrating on his swing. If his swing is properly executed, he will be aware that his backswing has ended at a proper position when the free end 22 taps him on his shoulder at a predetermined location. The nature of the soft resilient tip 22 will, of course, be such that the golfer will not be injured by the device in the event that he executes an improper swing pattern. If the swing is properly executed, the device will not contact the golfer's body during the follow-through portion of his swing.

I claim:

1. The combination comprising a golf club having an elongated shaft and including a club head at the lower end of said shaft, and a golf swing training device, said training device including an elongated member having a free end portion, and mounting means releasably securing said member to an upper portion of said shaft with said free end portion spaced from said shaft for angular adjustment relative to said shaft and about a supporting axis extending in a transverse direction relative to the longitudinal axis of said shaft and the longitudinal axis of said member and for rectilinear adjustment relative to said supporting axis and in the direction of the longitudinal axis of said member to vary the position of said free end relative to said supporting axis, said mounting means including a mounting member, a single fastener including an enlarged head having an aperture therethrough and a threaded shank projecting from said head and engaging said mounting member, the axis of said fastener comprising said supporting axis, said elongated member extending through said aperture and projecting outwardly in opposite directions beyond said head, and a clamping sleeve received on said head and disposed between said mounting member and said elongated member, said single fastener cooperating with said mounting member and said sleeve to releasably secure said mounting member to said club shaft and to releasably secure said elongated member in fixed position relative to said mounting member whereby said free end may be positioned to touch a portion of a golfer's body in the region of one of the golfer's shoulders when the golfer has executed a proper backswing with said golf club.

2. The combination as set forth in claim 1 wherein said mounting means includes a nut threadably engaged with said fastener for moving the members toward each other.

3. The combination as set forth in claim 2 wherein said clamping sleeve has abutment surfaces thereon engaging said elongated member and said mounting member.

4. The combination as set forth in claim 1 wherein said mounting member comprises a U-shaped bracket received on said shaft and having spaced apart legs including terminal end portions which project beyond said shaft at opposite sides thereof and said threaded fastener projects through said terminal end portions.

5. The combination as set forth in claim 1 wherein said elongated member comprises a rigid rod having a soft tip defining said free end.

6. The combination as set forth in claim 1 wherein said sleeve has notches therein aligned with said aperture and said elongated member extends through said notches.

7. The combination comprising a golf club having an elongated shaft and a golf swing training device releasably secured to said golf club and having a mounting bracket attached to said shaft, a single fastener having a head at one end and an elongated threaded shank projecting from said head and extending through said mounting bracket, said head having an aperture therethrough, a rod extending through said aperture and projecting outwardly in opposite directions beyond said head, a clamping sleeve carried by said fastener and at least partially disposed on said head in bearing engagement with said mounting bracket and said rod, and a nut threadably engaged with said shank and engaging said mounting bracket, said single fastener cooperating with said mounting bracket and said sleeve to releasably secure said mounting bracket to said club shaft and to releasably secure said rod in selected fixed position relative to said shaft.

* * * * *